US008444499B2

(12) United States Patent
Balardeta et al.

(10) Patent No.: US 8,444,499 B2
(45) **Date of Patent: *May 21, 2013**

(54) METHOD AND SYSTEM FOR SHOT TRACKING

(75) Inventors: Joseph Balardeta, Encinitas, CA (US); Scott Denton, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/429,118

(22) Filed: Mar. 23, 2012

(65) Prior Publication Data

US 2013/0079170 A1 Mar. 28, 2013

Related U.S. Application Data

(63) Continuation of application No. 12/837,136, filed on Jul. 15, 2010, now Pat. No. 8,142,302.

(60) Provisional application No. 61/229,831, filed on Jul. 30, 2009.

(51) Int. Cl.
*A63B 69/36* (2006.01)

(52) U.S. Cl.
USPC ..... 473/223; 473/222; 473/409

(58) Field of Classification Search
USPC ..... 473/219, 221, 222, 223, 226, 409
See application file for complete search history.

(56) References Cited

U.S. PATENT DOCUMENTS

| | | | | |
|---|---|---|---|---|
| 4,991,850 | A * | 2/1991 | Wilhlem | 473/233 |
| 6,224,493 | B1 * | 5/2001 | Lee et al. | 473/223 |
| 6,402,634 | B2 * | 6/2002 | Lee et al. | 473/223 |
| 6,431,990 | B1 * | 8/2002 | Manwaring | 473/199 |
| 7,883,428 | B1 * | 2/2011 | Balardeta et al. | 473/222 |
| 7,946,926 | B1 * | 5/2011 | Balardeta et al. | 473/222 |
| 8,142,302 | B2 * | 3/2012 | Balardeta et al. | 473/222 |
| 2011/0028230 | A1 * | 2/2011 | Balardeta et al. | 473/222 |

* cited by examiner

*Primary Examiner* — Nini Legesse
(74) *Attorney, Agent, or Firm* — Sonia Lari; Michael A. Catania; Rebecca Hanovice

(57) ABSTRACT

A system and method for shot tracking disclosed herein. The system preferably includes a golf club and a receiver. The golf club preferably includes an active RFID transponder, a power source, a switch and an accelerometer.

12 Claims, 9 Drawing Sheets

METHOD AND SYSTEM FOR SHOT TRACKING

CROSS REFERENCES TO RELATED APPLICATIONS

The Present application is a continuation application of U.S. patent application Ser. No. 12/837,136, filed on Jul. 15, 2010, which is hereby incorporated by reference in its entirety, which claims priority to U.S. Provisional Patent Application No. 61/229,831, filed on Jul. 30, 2009, now expired, both of which are hereby incorporated by reference in their entireties.

STATEMENT REGARDING FEDERALLY SPONSORED RESEARCH OR DEVELOPMENT

Not Applicable

BACKGROUND OF THE INVENTION

1. Field of the Invention

The present invention relates to shot tracking. More specifically, the present invention relates to a method and system for tracking shots of a golfer during a round of golf.

2. Description of the Related Art

Golf clubs combine with the players swing to propel a ball toward a favored location and through a favored path. The orientation and speed of the club head at impact largely determines the ball path including carry distance and roll.

The prior art is lacking in a method and system to measure the motion of the club through measurement of the shaft.

BRIEF SUMMARY OF THE INVENTION

The present invention is a system for automatically tracking shots of a golfer during a round of golf. The system includes a plurality of clubs and a receiver. Each of the plurality of golf clubs comprises a shaft and a golf club head. The golf club has an accelerometer in electrical communication with a wireless radiofrequency transponder. The accelerometer temporarily closes a switch during impact with a golf ball to provide power from a power source to the wireless radiofrequency transponder for transmission of a wireless signal. The wireless signal contains data for a specific golf club of the plurality of golf clubs. Each golf club of the plurality of golf clubs has an accelerometer, a wireless radiofrequency transponder, a switch, and a power source located within the shaft of the golf club. The receiver has a second antenna. The system captures a swing speed and swing motion of a golf club swung by golfer and wherein the interactions of characteristic three dimensional amplitude variations in the antennas allow for the measurement of relative positions of the golf club over the time of the swing.

Another aspect of the present invention is a method for automatically tracking shots of a golfer during a round of golf. The method includes impacting a golf ball with a golf club. The method also includes activating an accelerometer positioned within a shaft of the golf club. The method also includes closing a switch for a set time period, the switch positioned between a power source and a wireless radiofrequency transponder within the shaft of the golf club. The method also includes powering the wireless radiofrequency transponder with power from the power source. The method also includes transmitting a wireless signal from the wireless radiofrequency transponder, the wireless signal comprising golf club data for a swing speed and swing motion for the golf club swung by the golfer. The method also includes receiving the wireless signal at a receiver, the receiver having a second antenna. The interactions of characteristic three dimensional amplitude variations in the antennas allow for the measurement of relative positions of the golf club over the time of the swing.

The invention enables the accurate measurement and capture of the swing, produces a display of the impact and ball flight and thus improves the training and practice results for the golfer.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
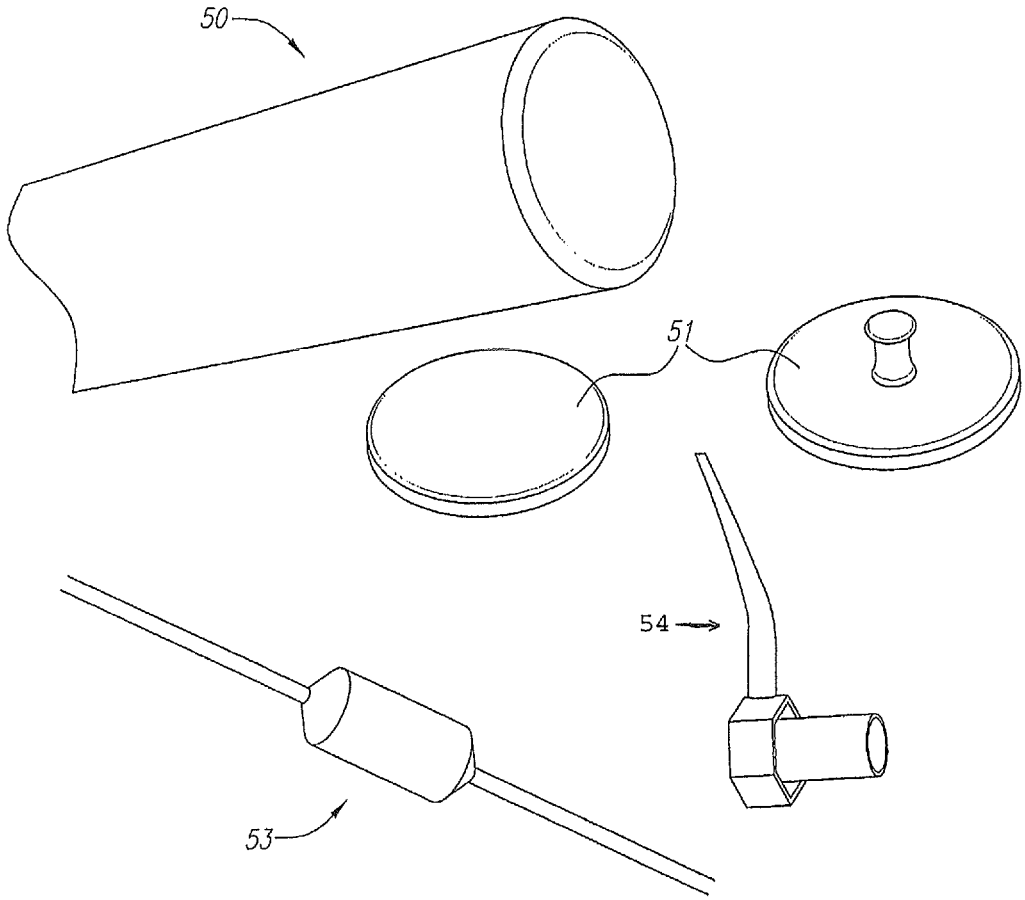
FIG. 1 is a perspective view of components of a system for shot tracking.

As shown in FIG. 1, components of the system can be attached to a golf club. Alternatively, the components can be integrated into a golf club.

Figure 2:
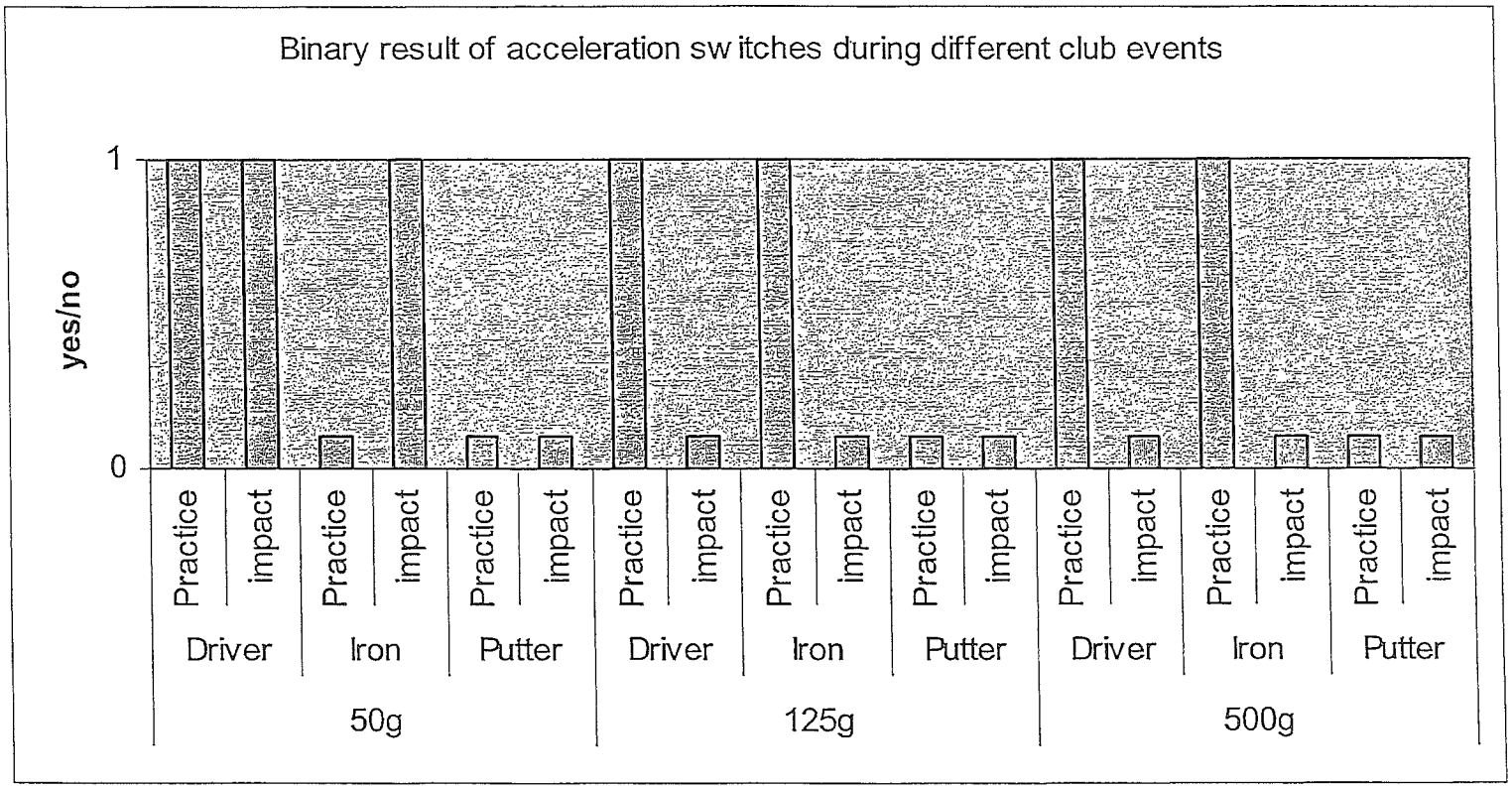
FIG. 2 is a graph of a binary result of acceleration switches during different club events.

FIG. 2 shows that different levels of acceleration switches can be effectively used to detect that a golf club has been used during by a golfer. A 50 g switch, a 125 g switch and a 500 g switch were used for this testing.

Figure 3:
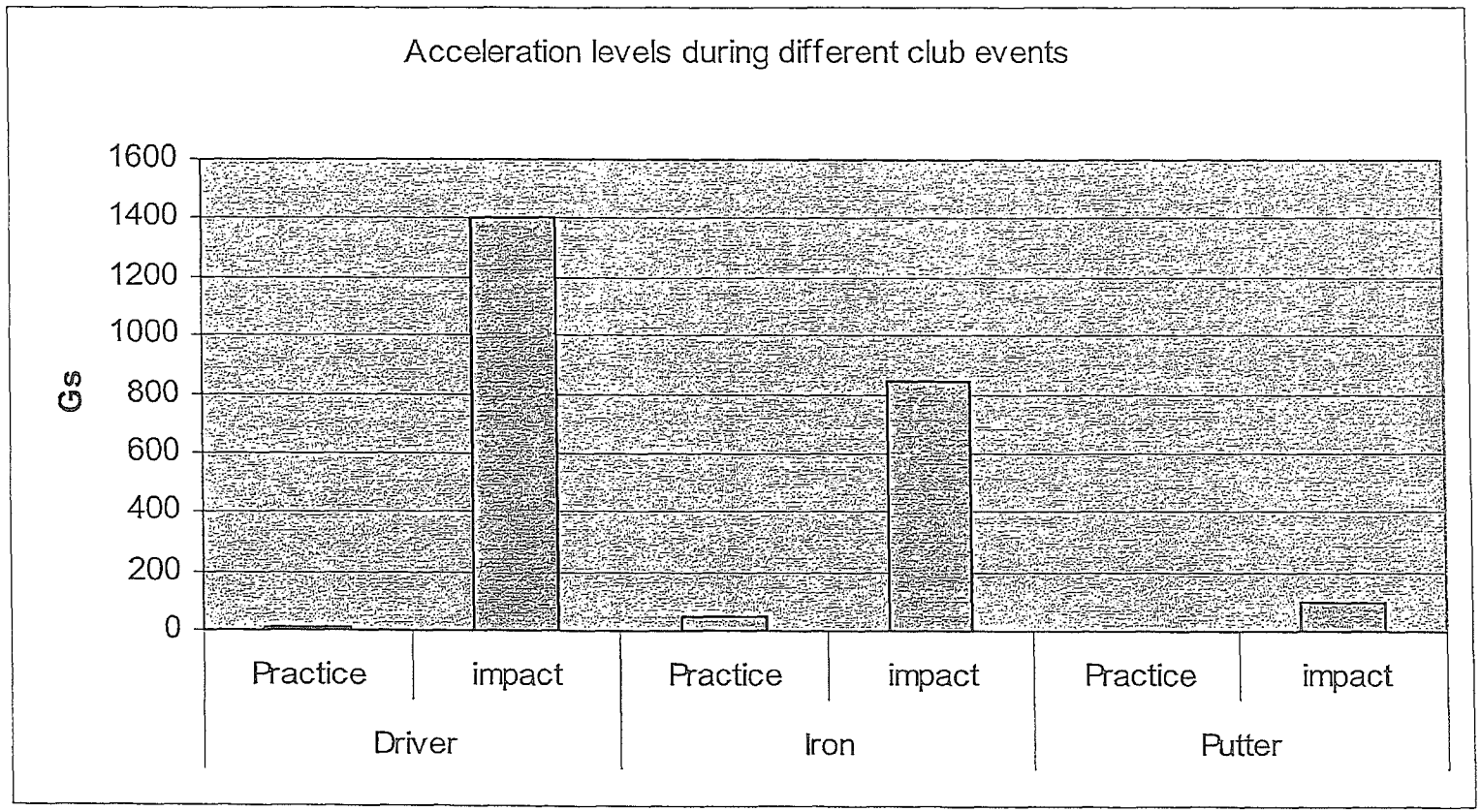
FIG. 3 is a graph of acceleration levels during different club events.

FIG. 3 shows the levels detected during a golf club impact with a golf ball.

Figure 4:
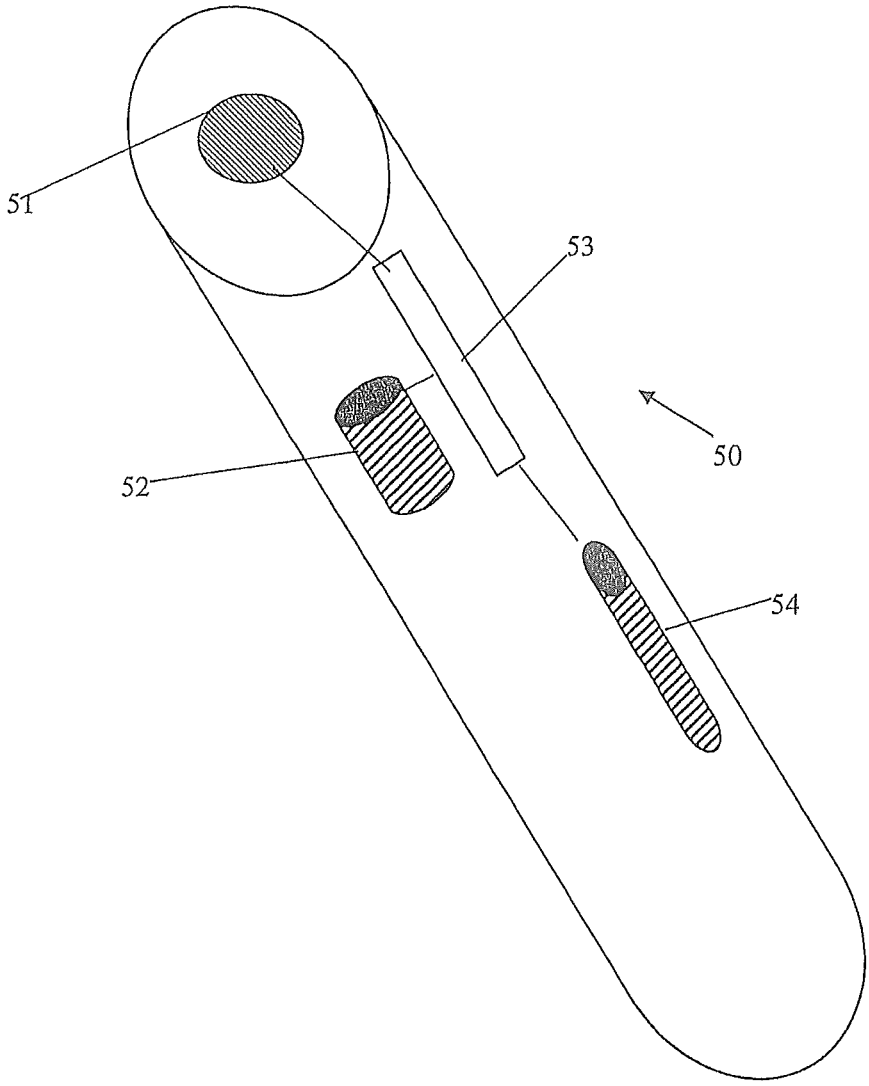
FIG. 4 is an illustration of a portion of a golf club illustrating the components.

FIG. 4 illustrates a portion of a golf club 50. The components of the system 20 within the golf club 50 preferably include an active RFID transponder 51, a power source 52, a switch 53 and an accelerometer 54. Those skilled in the pertinent art will recognize that the accelerometer and switch may be a single device.

Figure 5:
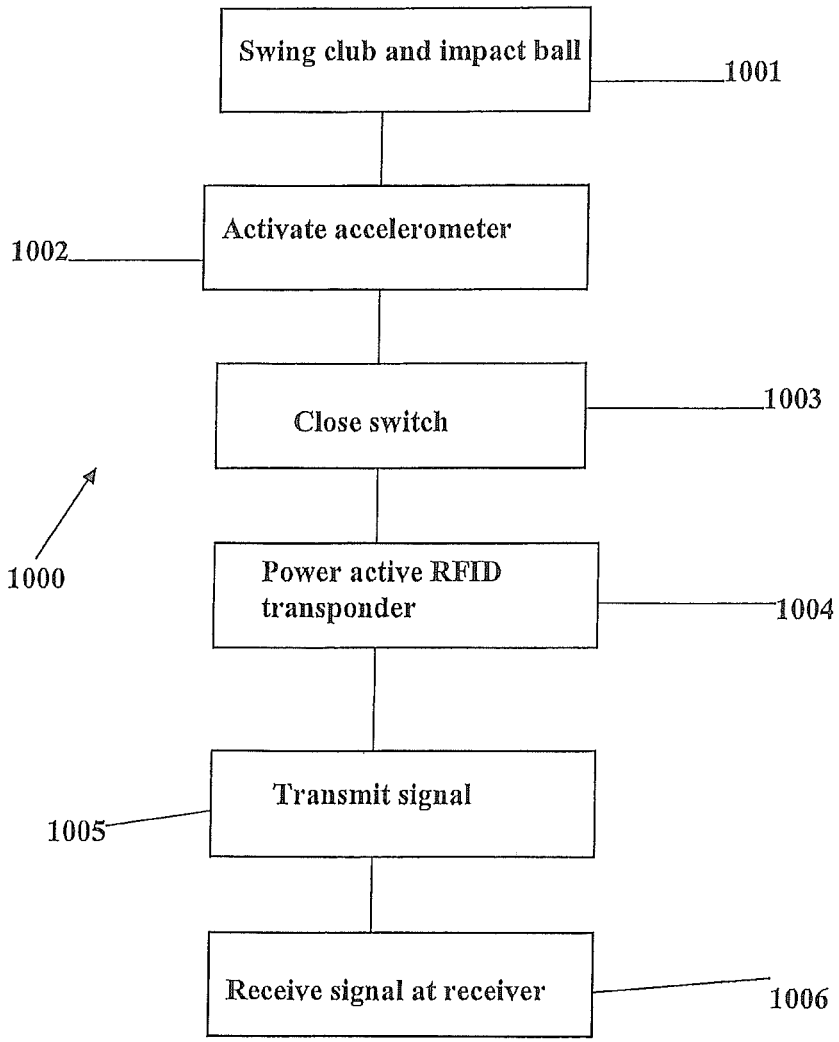
FIG. 5 is a flow chart of a method of shot tracking.

FIG. 5 is a flow chart of a method 1000 for shot tracking. At block 1001, a golfer swings a club and impacts a golf ball. At block 1002, an accelerometer is activated by the impact of the golf club with the golf ball. At block 1003, a switch located between a power source and an active RFID transponder is temporarily closed due to the activation of the accelerometer. At block 1004, the active RFID transponder is powered by the power source. At block 1005, the active RFID transponder transmits at least one signal containing data about the golf club. At block 1006, the signal is received at a receiver.

Figure 6:
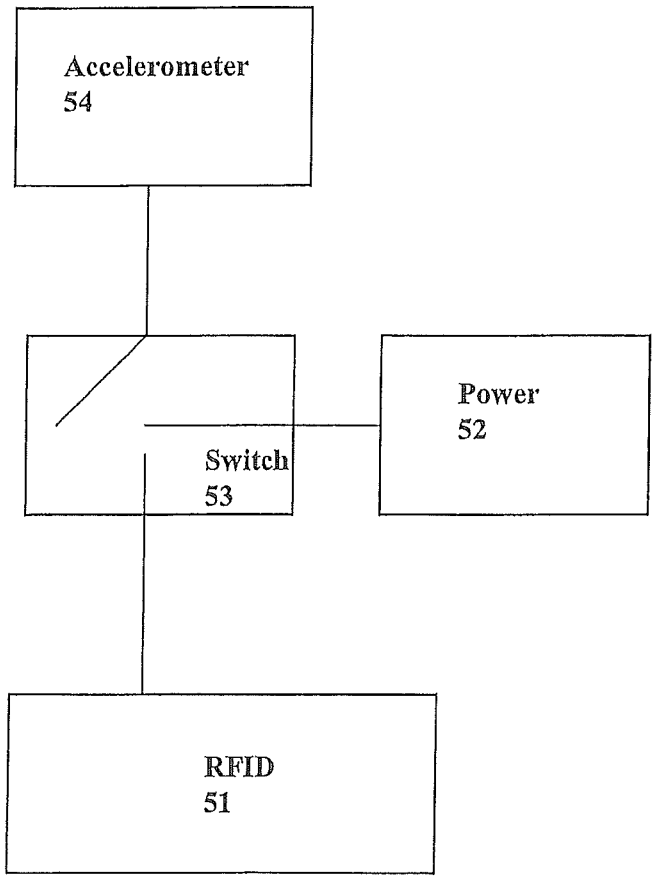
FIG. 6 is a block diagram of components of a system for shot tracking with the switch open.

FIG. 6 illustrates components of the system located within a golf club prior to impact of a golf club with a golf ball.

Figure 7:
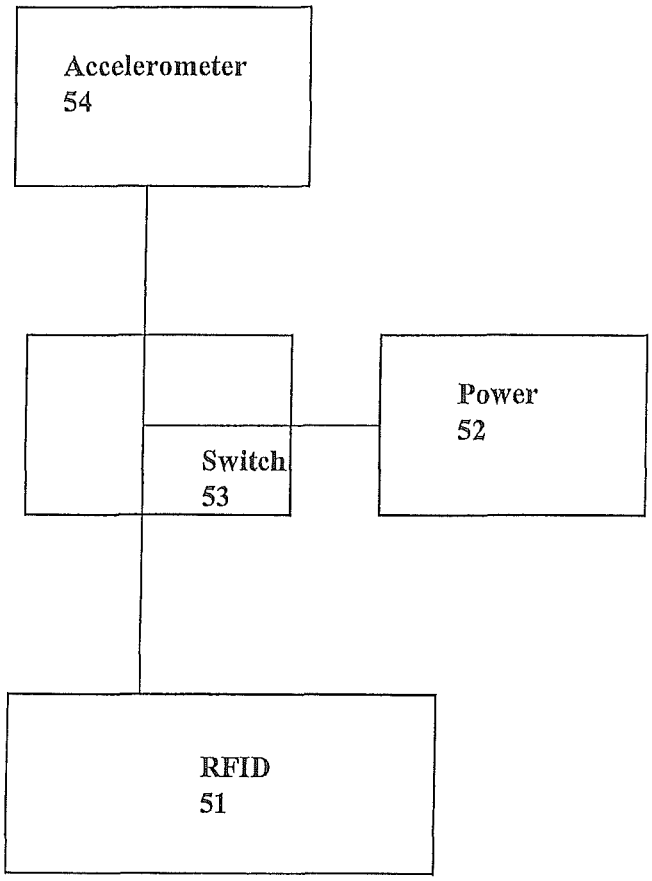
FIG. 7 is a block diagram of components of a system for shot tracking with the switch closed.

FIG. 7 illustrates components of the system located within a golf club subsequent to impact of a golf club with a golf ball.

Figure 8:
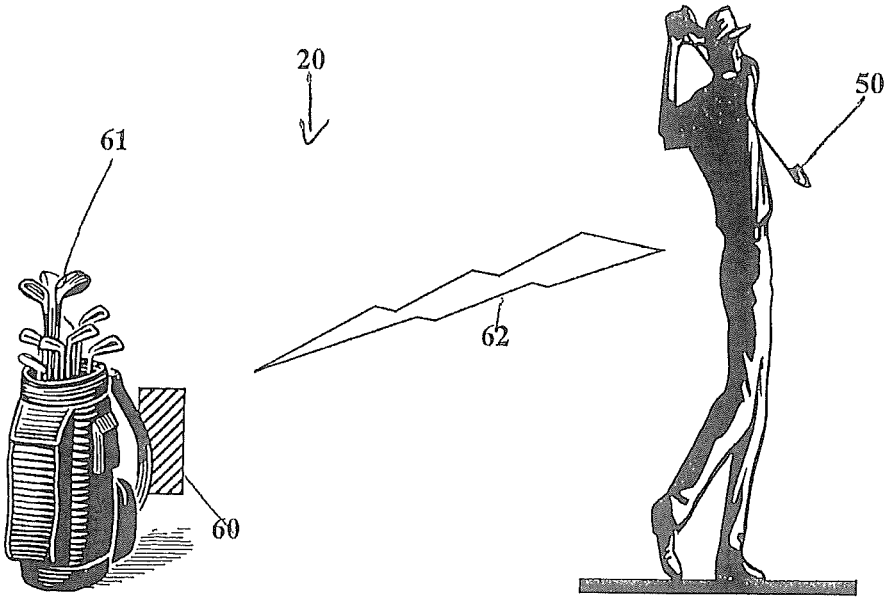
FIG. 8 is an illustration of a system for shot tracking.
Figure 8A:
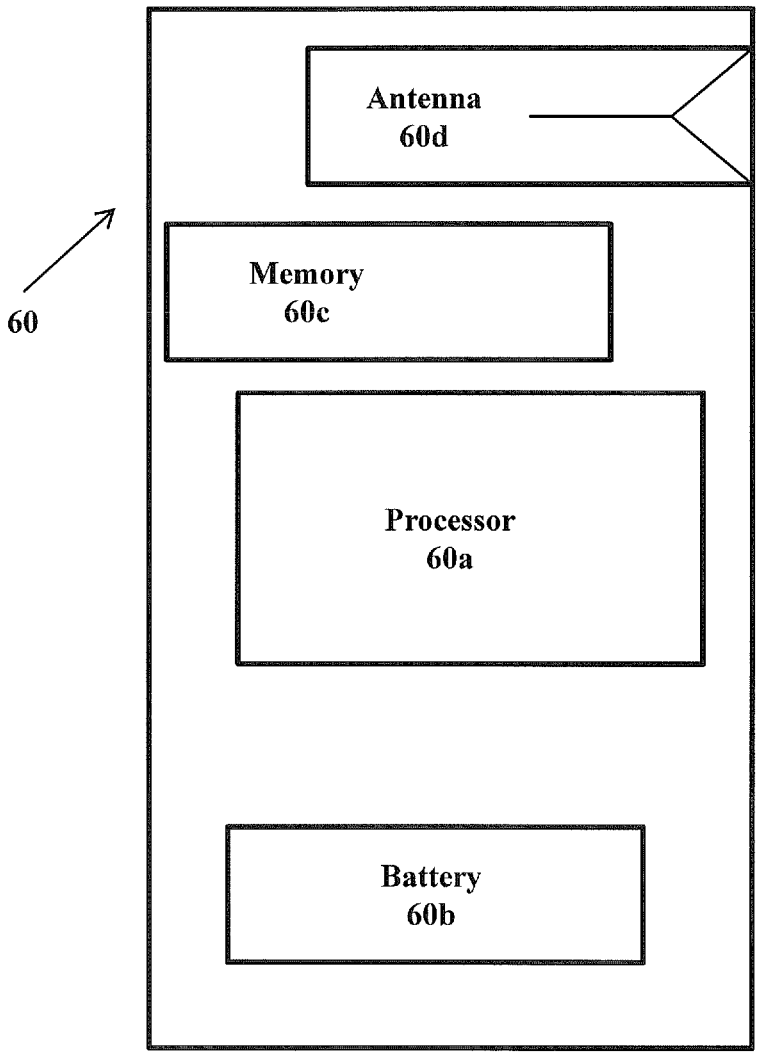
FIG. 8A is an illustration of the components of the receiver of FIG. 8.

FIG. 8 illustrates the system 20. A transponder in a golf club 50 swung by a golfer sends a signal 62 to a receiver 60. The receiver is attached to a golf bag 61, however, those skilled within the pertinent art will recognize that the receiver may be attached to any pertinent device including the golfer, or may stand alone. FIG. 8A is an illustration of the components of the receiver of FIG. 8. The receiver 60 preferably includes a processor 60*a*, a battery or power source 60*b*, a memory 60*c* and an antenna 60*d*.

The receiver is preferably a GPS device such as disclosed in Balardeta et al., U.S. Patent Publication Number 20090075761 for a Golf GPS Device And System, which is hereby incorporated by reference in its entirety. Alternatively, the receiver is a personal digital assistant (PDA), "smart phone", mobile phone, or other similar device. However, those skilled in the pertinent art will recognize that the receiver may be any device capable of receiving and storing signals from the RFID tag.

Gibbs, et al., U.S. Pat. No. 7,163,468 is hereby incorporated by reference in its entirety.

Galloway, et al., U.S. Pat. No. 7,163,470 is hereby incorporated by reference in its entirety.

Williams, et al., U.S. Pat. No. 7,166,038 is hereby incorporated by reference in its entirety.

Desmukh U.S. Pat. No. 7,214,143 is hereby incorporated by reference in its entirety.

Murphy, et al., U.S. Pat. No. 7,252,600 is hereby incorporated by reference in its entirety.

Gibbs, et al., U.S. Pat. No. 7,258,626 is hereby incorporated by reference in its entirety.

Galloway, et al., U.S. Pat. No. 7,258,631 is hereby incorporated by reference in its entirety.

Evans, et al., U.S. Pat. No. 7,273,419 is hereby incorporated by reference in its entirety.

Hocknell, et al., U.S. Pat. No. 7,413,250 is hereby incorporated by reference in its entirety.

The measurements may be inputted into an impact code such as the rigid body code disclosed in U.S. Pat. No. 6,821,209, entitled Method for Predicting a Golfer's Ball Striking Performance, which is hereby incorporated by reference in its entirety.

The swing properties are preferably determined using an acquisition system such as disclosed in U.S. Pat. No. 6,431,990, entitled System and Method for Measuring a Golfer's Ball Striking Parameters, assigned to Callaway Golf Company, the assignee of the present application, and hereby incorporated by reference in its entirety. However, those skilled in the pertinent art will recognize that other acquisition systems may be used to determine the swing properties.

Other methods that are useful in obtaining a golfer's swing characteristics are disclosed in U.S. Pat. No. 6,638,175, for a Diagnostic Golf Club System, U.S. Pat. No. 6,402,634, for an Instrumented Golf Club System And Method Of Use, and U.S. Pat. No. 6,224,493, for an Instrumented Golf Club System And Method Of Use, all of which are assigned to Callaway Golf Company, the assignee of the present application, and all of which are hereby incorporated by reference in their entireties.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention the following:

1. A system for automatically tracking shots of a golfer during a round of golf, the system comprising:

a plurality of golf clubs, each of the plurality of golf clubs comprising a shaft and a golf club head, the golf club having an accelerometer in electrical communication with a wireless radiofrequency transponder, the accelerometer temporarily closing a switch during impact with a golf ball to provide power from a power source to the wireless radiofrequency transponder for transmission of a wireless signal, the wireless signal containing data for a specific golf club of the plurality of golf clubs, wherein each golf club of the plurality of golf clubs has the accelerometer, the wireless radiofrequency transponder, the switch, and the power source located within the shaft of the golf club; and the receiver having a second antenna;

wherein the system captures a swing speed and swing motion of a golf club swung by golfer and wherein the interactions of characteristic three dimensional amplitude variations in the antennas allow for the measurement of relative positions of the golf club over the time of the swing.

2. The system according to claim 1 wherein the receiver is a GPS unit.

3. The system according to claim 1 wherein the receiver stores data for each shot by the golfer for a round of golf.

4. The system according to claim 1 wherein the data of the signal comprises type of club and force of the shot.

5. The system according to claim 1 wherein the type of golf club of the plurality of golf clubs is selected from wedge, 9-iron, 8-iron, 7-iron, 6-iron, 5-iron, 4-iron, 3-iron, 2-iron, 9-wood, 7-wood, 5-wood, 3-wood, driver, putter, 1-hybird, 2-hybrid, 3-hybrid, 4-hybrid, 5-hybrid and 6-hybrid.

6. The system according to claim 1 wherein the accelerometer is a 50 G accelerometer.

7. A method for automatically tracking shots of a golfer during a round of golf, the method comprising:

impacting a golf ball with a golf club;

activating an accelerometer positioned within a shaft of the golf club;

closing a switch for a set time period, the switch positioned between a power source and a wireless radiofrequency transponder within the shaft of the golf club;

powering the wireless radiofrequency transponder with power from the power source;

transmitting a wireless signal from the wireless radiofrequency transponder, the wireless signal comprising golf club data for a swing speed and swing motion for the golf club swung by the golfer; and receiving the wireless signal at a receiver, the receiver having a second antenna;

wherein the interactions of characteristic three dimensional amplitude variations in the antennas allow for the measurement of relative positions of the golf club over the time of the swing.

8. The method according to claim 7 wherein the receiver is a GPS unit.

9. The method according to claim 7 wherein the receiver stores data for each shot by the golfer for a round of golf.

10. The method according to claim 7 wherein the data of the wireless signal comprises type of club and force of the shot.

11. The method according to claim 7 wherein the type of club is selected from wedge, 9-iron, 8-iron, 7-iron, 6-iron, 5-iron, 4-iron, 3-iron, 2-iron, 9-wood, 7-wood, 5-wood, 3-wood, driver, putter, 1-hybird, 2-hybrid, 3-hybrid, 4-hybrid, 5-hybrid and 6-hybrid.

12. The method according to claim 7 wherein the accelerometer is a 500 G accelerometer.

* * * * *